US012285699B1

(12) United States Patent
Lenyon et al.

(10) Patent No.: US 12,285,699 B1
(45) Date of Patent: Apr. 29, 2025

(54) NOVELTY DEVICE FOR KICKING A USER'S BUTTOCKS

(71) Applicants: Doris Lenyon, Woodbridge, VA (US); Rose Robbins, Woodbridge, VA (US)

(72) Inventors: Doris Lenyon, Woodbridge, VA (US); Rose Robbins, Woodbridge, VA (US)

( * ) Notice: Subject to any disclaimer, the term of this patent is extended or adjusted under 35 U.S.C. 154(b) by 142 days.

(21) Appl. No.: 17/883,697

(22) Filed: Aug. 9, 2022

(51) Int. Cl.
*A63H 13/06* (2006.01)

(52) U.S. Cl.
CPC ..... *A63H 13/06* (2013.01)

(58) Field of Classification Search
CPC ..... A63H 13/06
See application file for complete search history.

(56) References Cited

U.S. PATENT DOCUMENTS 654,611 A 7/1900 De Moulin
920,837 A 5/1909 De Moulin
1,322,199 A * 11/1919 Murphy ..... A63H 7/02 D21/590
4,122,822 A * 10/1978 Scheiwiller ..... A63B 69/408 124/36
4,365,612 A * 12/1982 Defosse ..... A63B 69/40 124/50
4,457,100 A * 7/1984 Nightingale ..... A63H 13/00 446/163
4,712,968 A * 12/1987 Manning ..... E02F 3/427 446/427
5,904,660 A * 5/1999 Kim ..... A61H 1/00 601/118
6,280,285 B1 * 8/2001 Morehouse ..... A63F 7/2472 124/79
6,293,874 B1 * 9/2001 Armstrong ..... A63B 22/0005 472/51
6,715,477 B1 * 4/2004 Gilman ..... A63B 69/40 124/16
7,192,331 B1 3/2007 Ward
2006/0030434 A1 * 2/2006 Horkan ..... A63B 69/408 473/438
2006/0094518 A1 * 5/2006 Leavitt ..... A61H 1/006 472/51

FOREIGN PATENT DOCUMENTS

CN 213786331 U * 7/2021 ..... A63B 69/40
EP 2460505 4/2014

OTHER PUBLICATIONS

Translation CN213786331U (Year: 2021).*

* cited by examiner

*Primary Examiner* — Eugene L Kim
*Assistant Examiner* — Alyssa M Hylinski

(57) ABSTRACT

The novelty device for kicking a user's buttocks is a disciplinary device. The novelty device for kicking a user's buttocks exchanges momentum between an appropriate authority and a client. The momentum exchange occurs between the novelty device for kicking a user's buttocks and the buttocks of the client. The novelty device for kicking a user's buttocks comprises a frame structure, a mechanical linkage, and a disciplinary tool. The frame structure elevates the mechanical linkage and the disciplinary tool above a supporting surface. The mechanical linkage forms an energy transfer device that transfers the energy generated by the appropriate authority to the disciplinary tool. The disciplinary tool is a rotating structure. The disciplinary tool converts the received energy from the appropriate authority into a rotation with angular momentum. The disciplinary tool rotates until the disciplinary tool impacts the client.

9 Claims, 6 Drawing Sheets

NOVELTY DEVICE FOR KICKING A USER'S BUTTOCKS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of visual systems for entertaining, instructing and motivating a user. (A63B71/0622)

Summary of Invention

The novelty device for kicking a user's buttocks is a disciplinary device. The novelty device for kicking a user's buttocks is a striking tool. The novelty device for kicking a user's buttocks exchanges momentum between an appropriate authority and a client. The momentum exchange occurs between the novelty device for kicking a user's buttocks and the buttocks of the client. The novelty device for kicking a user's buttocks comprises a frame structure, a mechanical linkage, and a disciplinary tool. The frame structure elevates the mechanical linkage and the disciplinary tool above a supporting surface. The mechanical linkage forms an energy transfer device that transfers the energy generated by the appropriate authority to the disciplinary tool. The disciplinary tool is a rotating structure. The disciplinary tool converts the received energy from the appropriate authority into a rotation with angular momentum. The disciplinary tool rotates until the disciplinary tool impacts the client. The impact of the disciplinary tool with the client transfers momentum to the buttocks of the client.

These together with additional objects, features and advantages of the novelty device for kicking a user's buttocks will be readily apparent to those of ordinary skill in the art upon reading the following detailed description of the presently preferred, but nonetheless illustrative, embodiments when taken in conjunction with the accompanying drawings.

In this respect, before explaining the current embodiments of the novelty device for kicking a user's buttocks in detail, it is to be understood that the novelty device for kicking a user's buttocks is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the novelty device for kicking a user's buttocks.

It is therefore important that the claims be regarded as including such equivalent construction insofar as they do not depart from the spirit and scope of the novelty device for kicking a user's buttocks. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
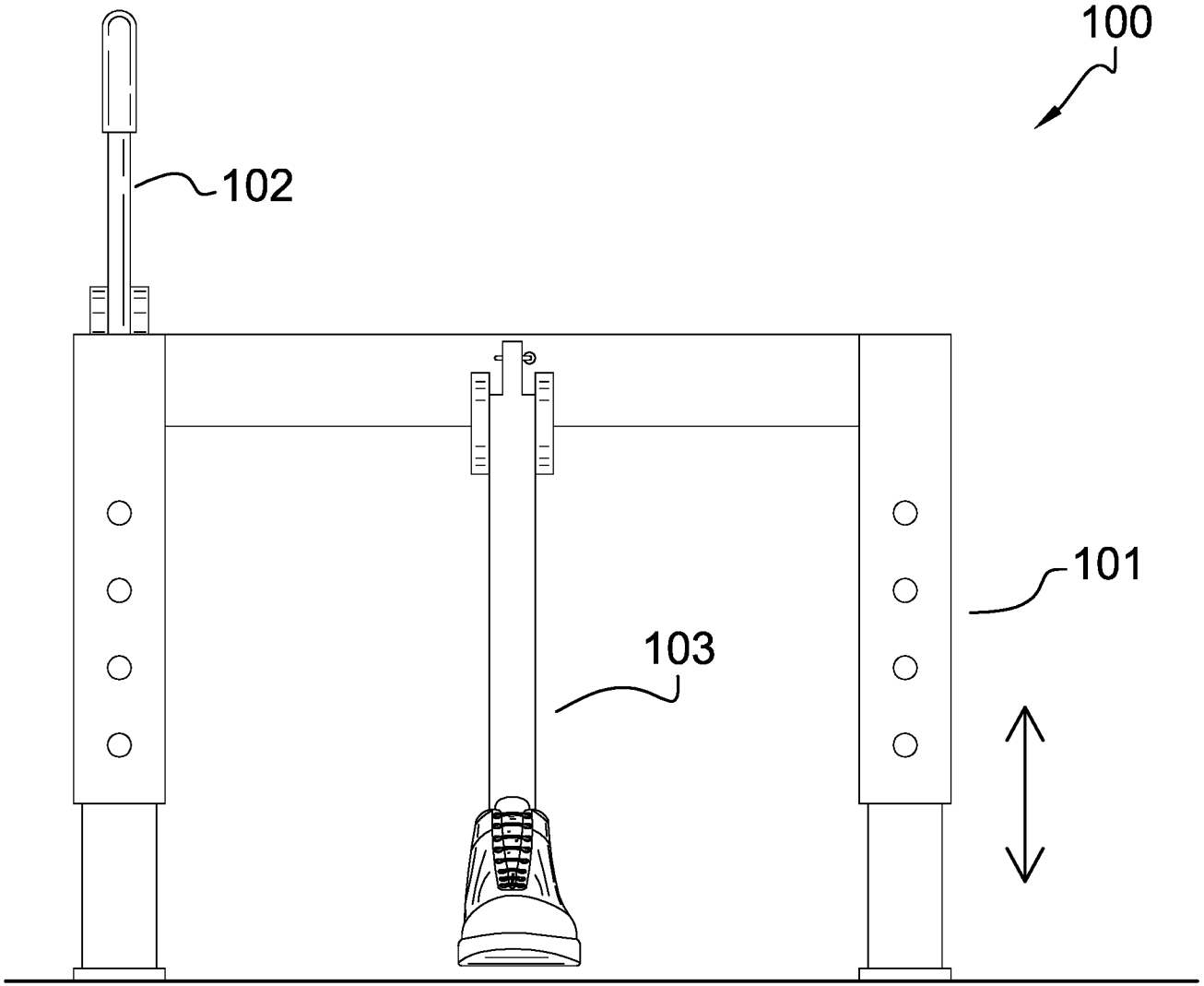
FIG. 1 is a front view of an embodiment of the disclosure.
Figure 2:
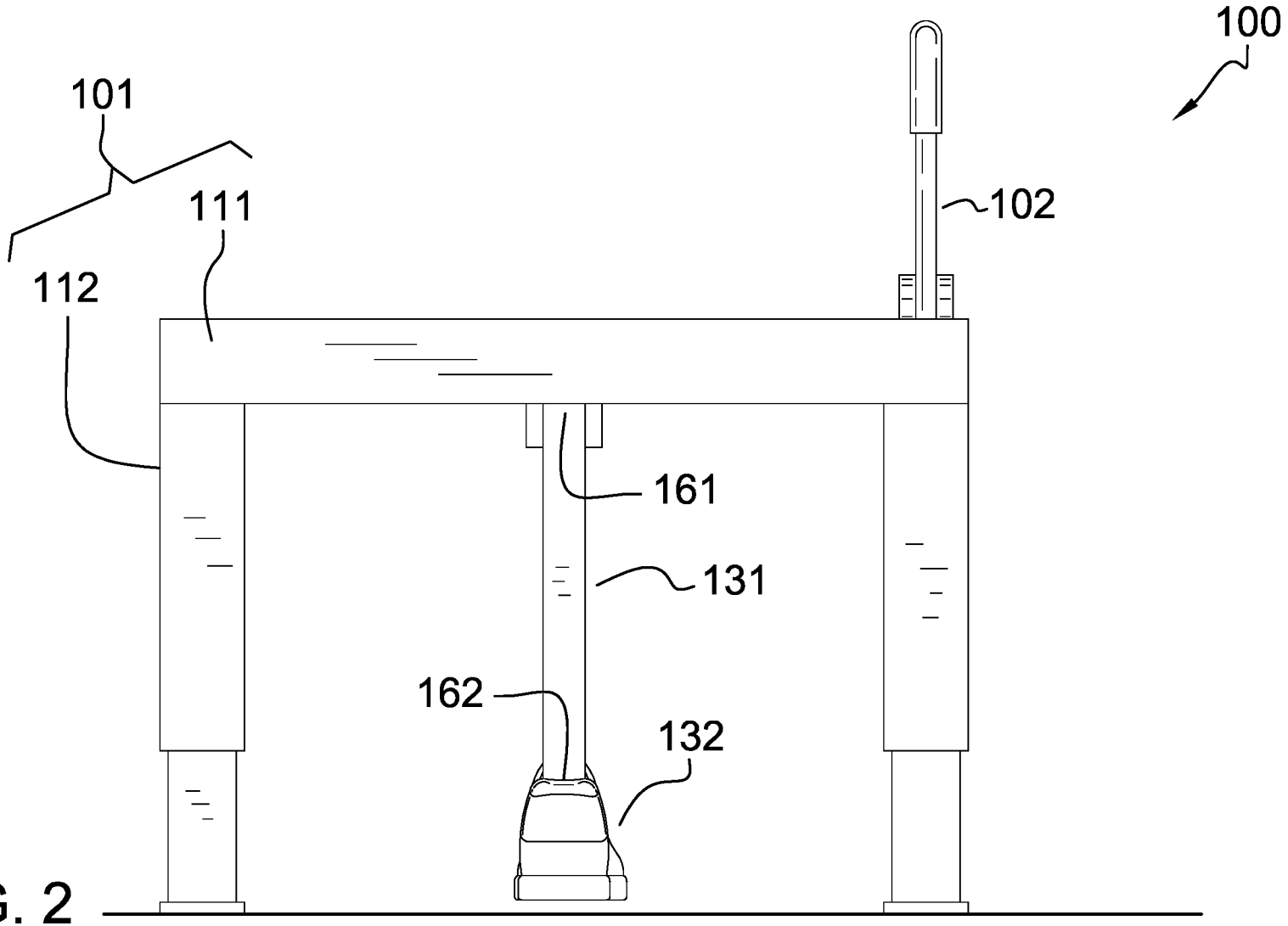
FIG. 2 is a rear view of an embodiment of the disclosure.
Figure 3:
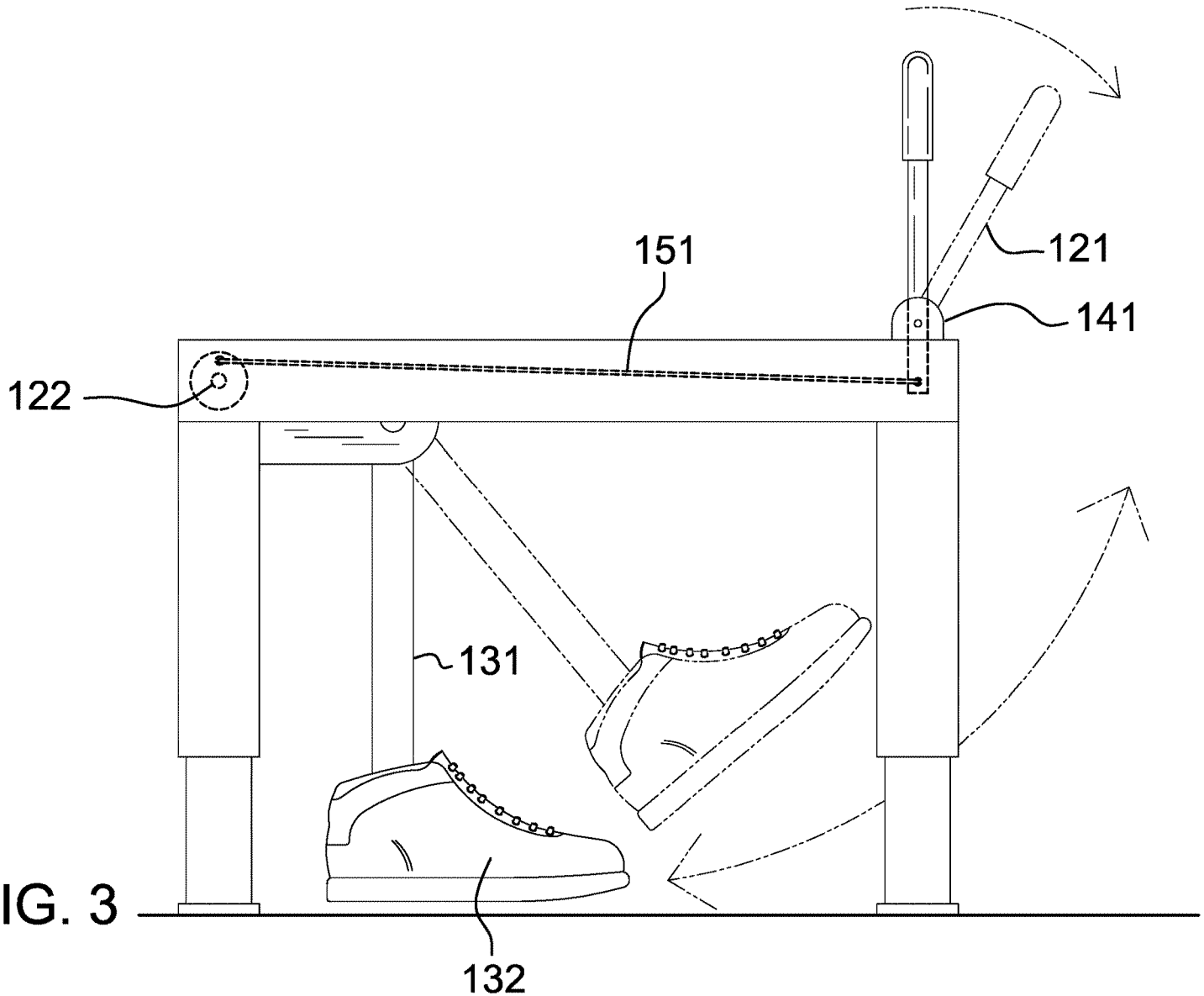
FIG. 3 is a side view of an embodiment of the disclosure.
Figure 4:
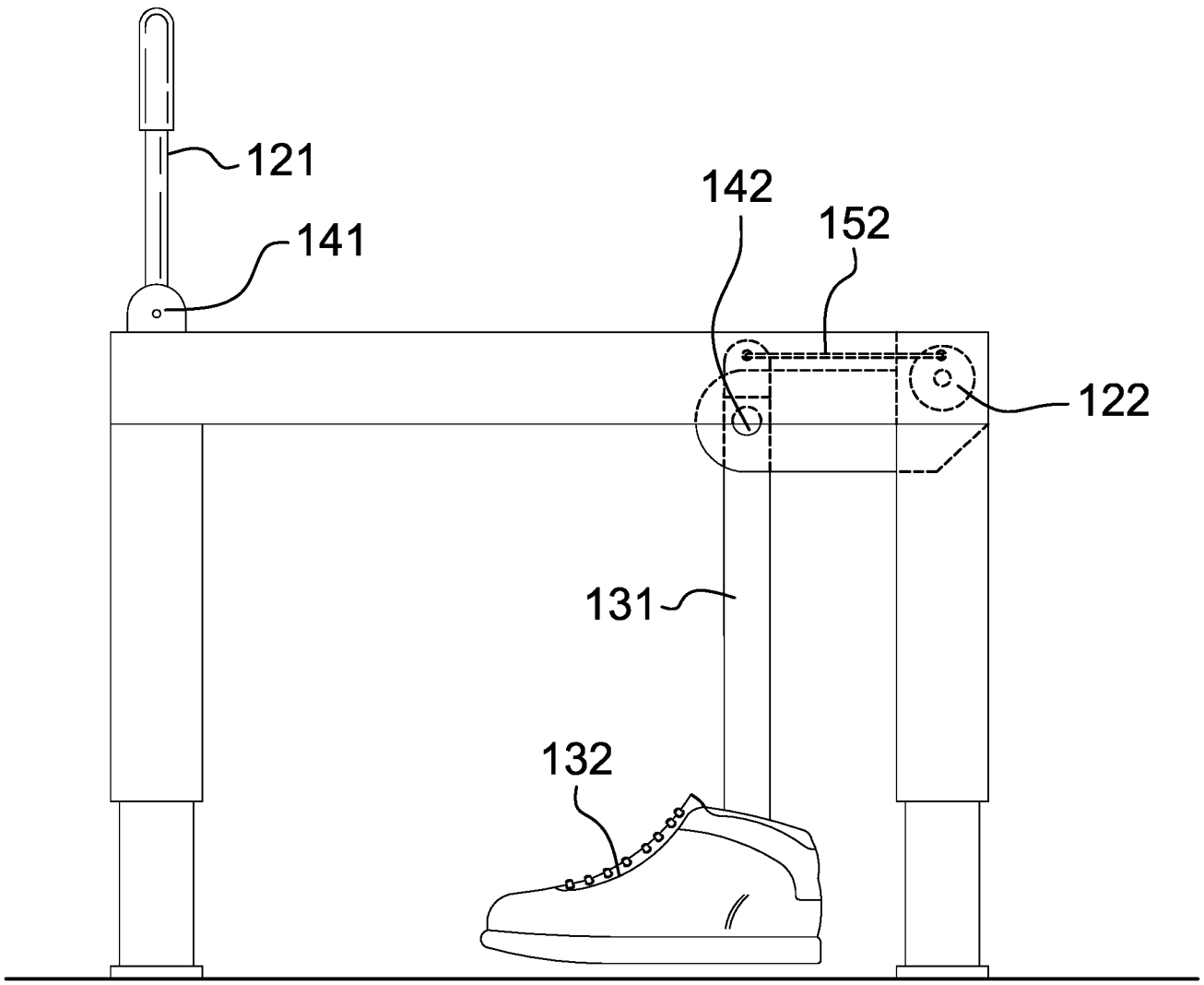
FIG. 4 is a reverse side view of an embodiment of the disclosure.
Figure 5:
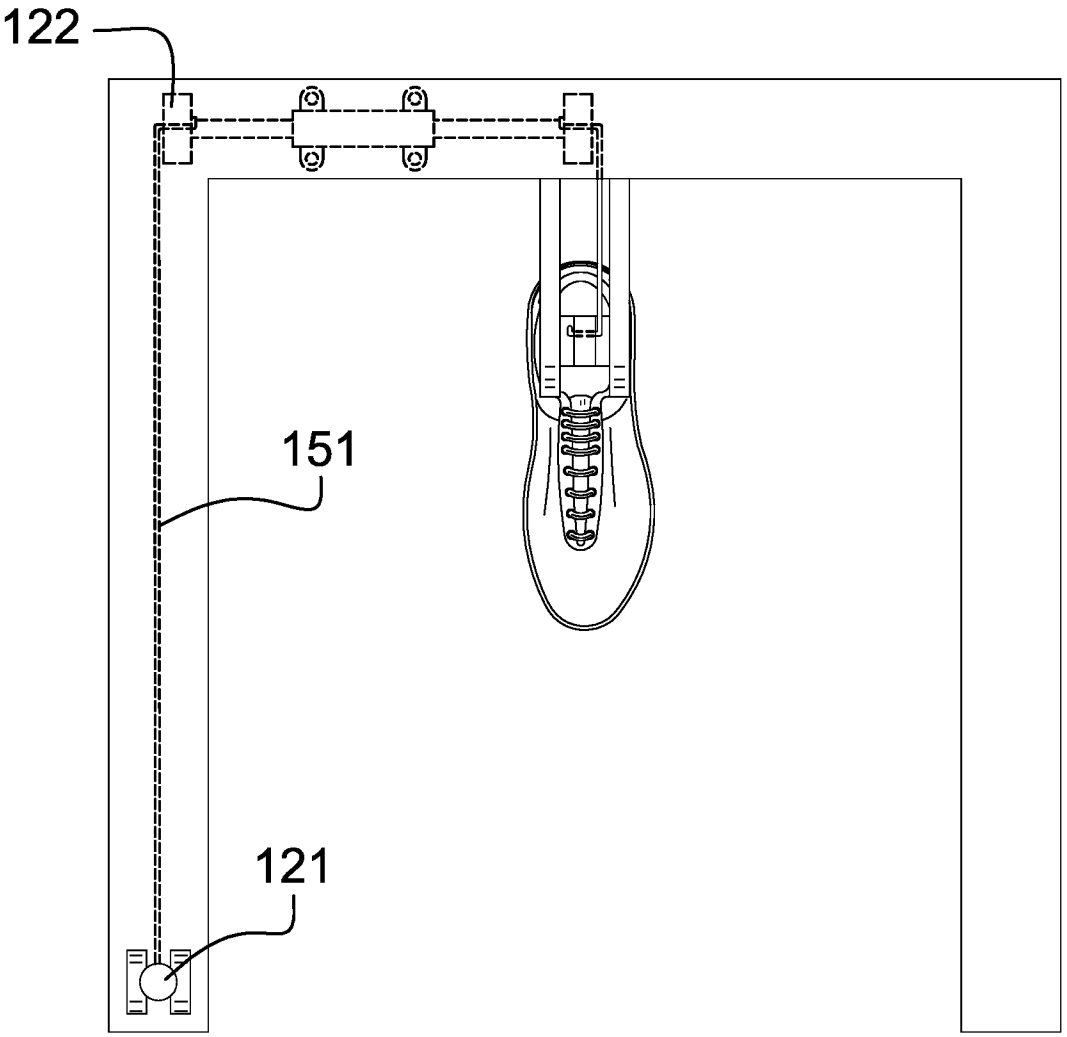
FIG. 5 is a top view of an embodiment of the disclosure.
Figure 6:
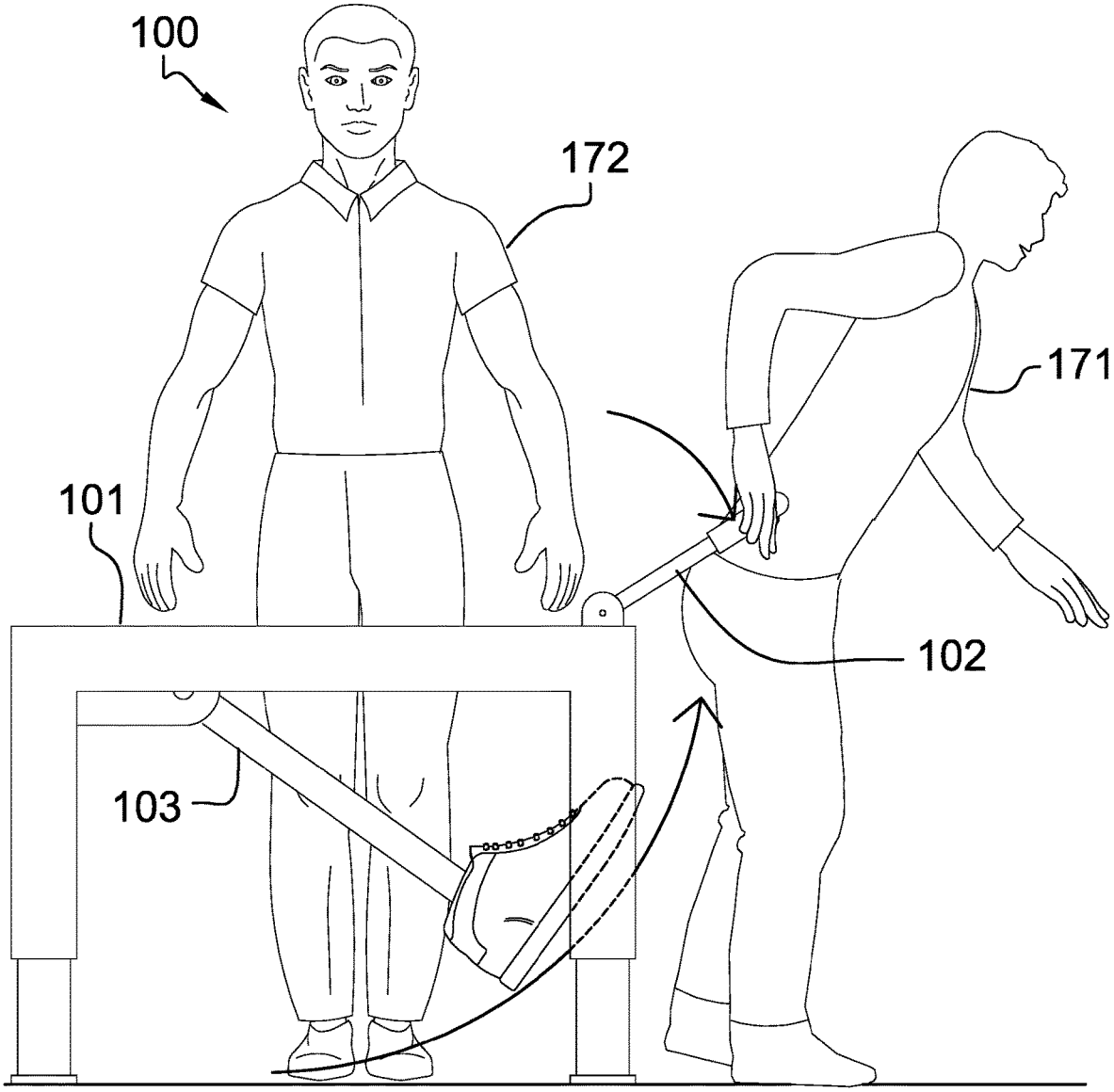
FIG. 6 is an in-use view of an embodiment of the disclosure.

Detailed reference will now be made to one or more potential embodiments of the disclosure, which are illustrated in FIGS. 1 through 6.

The novelty device for kicking a user's buttocks 100 (hereinafter invention) is a disciplinary device. The invention 100 is a striking tool. The invention 100 exchanges momentum between an appropriate authority 172 and a client 171. The momentum exchange occurs between the invention 100 and the buttocks of the client 171. The invention 100 comprises a frame structure 101, a mechanical linkage 102, and a disciplinary tool 103. The frame structure 101 elevates the mechanical linkage 102 and the disciplinary tool 103 above a supporting surface. The mechanical linkage 102 forms an energy transfer device that transfers the energy generated by the appropriate authority 172 to the disciplinary tool 103. The disciplinary tool 103 is a rotating structure. The disciplinary tool 103 converts the received energy from the appropriate authority 172 into a rotation with angular momentum. The disciplinary tool 103 rotates until the disciplinary tool 103 impacts the client 171. The impact of the disciplinary tool 103 with the client 171 transfers momentum to the buttocks of the client 171.

The frame structure 101 is a pedestal structure. The mechanical linkage 102 and the disciplinary tool 103 attach to the frame structure 101. The frame structure 101 forms a platform that elevates the mechanical linkage 102 and the disciplinary tool 103 above the supporting surface the invention 100 rests. The frame structure 101 forms the load path that transfers the loads of the mechanical linkage 102 and the disciplinary tool 103 to the supporting surface. The frame structure 101 forms a space where the client 171 stands to receive disciplinary action. The frame structure 101 comprises a suspension platform 111 and a plurality of telescopic legs 112.

The suspension platform 111 is a rigid structure. The suspension platform 111 is a u-shaped structure. The suspension platform 111 attaches to the plurality of telescopic legs 112. The suspension platform 111 attaches to the plurality of telescopic legs 112 such that the center axes of a first arm, a second arm, and a crossbeam of the u-shaped structure of the suspension platform 111 are horizontally oriented. The suspension platform 111 is sized such that the client 171 can stand between the free end of the first arm of the u-shaped structure of the suspension platform 111 and the free end of the second arm of the u-shaped structure of the suspension platform while receiving disciplinary action. The mechanical linkage 102 mounts on the suspension platform 111.

The plurality of telescopic legs 112 transfers the load borne by the suspension platform 111 to the supporting surface. Each telescopic leg selected from the plurality of telescopic legs 112 is a rigid structure. Each selected telescopic leg is a composite prism structure. Each selected telescopic leg is a load bearing structure. Each selected telescopic leg transfers a portion of the load borne by the frame structure 101 to the supporting surface. Each selected telescopic leg is an adjustable structure. By adjustable is meant that the span of the length of the center axis of the composite prism structure of each telescopic leg selected from the plurality of telescopic legs 112 can be changed.

The suspension platform 111 attaches to the plurality of telescopic legs 112 such that the plurality of telescopic legs 112 elevates the suspension platform 111 above the supporting surface. The elevation of the suspension platform 111 above the supporting surface adjusts by adjusting the span of the length of the center axis of each selected telescopic leg.

In the first potential embodiment of the disclosure, each selected telescopic leg is a telescopic structure.

The mechanical linkage 102 is a mechanical device. The mechanical linkage 102 is operated by an appropriate authority 172. The mechanical linkage 102 forms a mechanical linkage 102 between the appropriate authority 172 and the disciplinary tool 103. The mechanical linkage 102 receives the motive forces required to operate the disciplinary tool 103 from the appropriate authority 172. The mechanical linkage 102 transfers the rotational energy received from the appropriate authority 172 to the disciplinary tool 103. The mechanical linkage 102 comprises a lever 121, a cam 122, a first pivot 141, a second pivot 142, a first connecting rod 151, and a second connecting rod 152.

The first pivot 141 is a pivot. The first pivot 141 is a rotating structure. The first pivot 141 secures the lever 121 to the suspension platform 111 such that the lever 121 rotates relative to the suspension platform 111.

The second pivot 142 is a pivot. The second pivot 142 is a rotating structure. The second pivot 142 secures the disciplinary tool 103 to the suspension platform 111 such that the disciplinary tool 103 rotates relative to the suspension platform 111.

The first connecting rod 151 is a rigid structure. The first connecting rod 151 is a prism shaped structure. The first connecting rod 151 is a transfer structure. The first connecting rod 151 transfers rotational energy received from the lever 121 to the cam 122.

The second connecting rod 152 is a rigid structure. The second connecting rod 152 is a prism shaped structure. The second connecting rod 152 is a transfer structure. The second connecting rod 152 transfers rotational energy received from the cam 122 to the disciplinary tool 103.

The lever 121 is a rigid structure. The lever 121 is a rotating structure. The lever 121 mechanically attaches to the first pivot 141. The lever 121 mechanically attaches to the first connecting rod 151. The appropriate authority 172 pulls on the lever 121 such that the lever 121 rotates around the first pivot 141. The lever 121 attaches to a congruent end of the first connecting rod 151 such that the rotation of the lever 121 moves the first connecting rod 151 in a linear direction that is aligned with the center axis of the first connecting rod 151.

The cam 122 is a mechanical device. The purpose of the cam 122 is to convert: a) linear motion into rotational motion; and, b) rotational motion into linear motion. The cam 122 attaches to the congruent end of the first connecting rod 151 that is distal from the lever 121. The cam 122 attaches to a congruent end of the second connecting rod 152. The cam 122 attaches to the first connecting rod 151 such that the linear motion of the first connecting rod 151 causes the cam 122 to rotate. The rotation of the cam 122 causes the second connecting rod 152 to move in a linear motion. The second connecting rod 152 moves in a linear direction that is aligned with the center axis of the second connecting rod 152.

The disciplinary tool 103 is a tool. The disciplinary tool 103 receives rotational energy from the mechanical linkage 102. The disciplinary tool 103 rotates such that the disciplinary tool 103 impacts the buttocks of the client 171. The disciplinary tool 103 transfers momentum to the buttocks of the client 171. The disciplinary tool 103 comprises a handle 131 and a working element 132.

The handle 131 is a rigid structure. The handle 131 is a prism shaped structure. The handle 131 forms the handle 131 of the tool formed by the disciplinary tool 103. The second pivot 142 attaches the handle 131 to the suspension platform 111 such that the handle 131 rotates relative to the suspension platform 111. The second connecting rod 152 attaches to the fixed end 161 of the handle 131. The handle 131 attaches to the second connecting rod 152 such that the linear motion of the second connecting rod 152 causes the handle 131 to rotate around the second pivot 142. The rotation of the handle 131 around the center of rotation formed by the second connecting rod 152 causes the working element 132 to also rotate around a center of rotation aligned with the second connecting rod 152.

The handle 131 comprises a fixed end 161 and a free end 162. The fixed end 161 is the congruent end of the handle 131 that is proximal to the suspension platform 111. The fixed end 161 is the congruent end of the working element 132 that is distal from the free end 162. The free end 162 is the congruent end of the handle 131 that is distal to the suspension platform 111. The free end 162 is the congruent end of the working element 132 that is distal from the fixed end 161. The working element 132 attaches to the free end 162.

The working element 132 is a mass that attaches to the free end 162 of the handle 131. The working element 132 forms the physical structure that impacts the buttock of the client 171 during the administration of disciplinary action. The rotation of the working element 132 transfers momentum from the working element 132 to the client 171. In the first potential embodiment of the disclosure, the form factor of the working element 132 resembles footwear.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Appropriate Authority: As used in this disclosure, an appropriate authority is a previously determined person or organization that is designated to monitor compliance with, and if necessary enforce, regulatory and legal mandates.

Bracket: As used in this disclosure, a bracket is a mechanical structure that attaches a second structure to a first structure such that the load path of the second structure is fully transferred to the first structure.

Buttock: As used in this disclosure, the buttock refers to one of two rounded portions of the rump that: 1) in combination form the inferior region of the torso; and, 2) individually forms the superior region of a leg in a bi-pedal creature or the rear leg of a multi-legged creature. The buttock is often referred informally as the "butt."

Cam: As used in this disclosure, a cam is a mechanical device that converts: 1) a rotating motion into a linear motion; or, 2) a linear motion into a rotating motion.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism, or pyramidal structures share the same line they are said to be aligned. When the center axes of two cylinder, prism or pyramidal structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Client: As used in this disclosure, a client is an individual who is designated to receive the services of the disclosure at bar.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Discipline: As used in this disclosure, discipline refers to a mechanism or process that corrects or chastises an improper action or behavior.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Energy: As used in this disclosure, the energy is a term used in physics. Energy refers to the ability of a system to do work. Energy is a conserved property of a system. Energy is a quantifiable and is generally expressed in units of Joules.

Extend: As used in this disclosure, to extend takes a meaning selected from the group consisting of: a) increasing the reach of a line that connects a first object to a second object; and, b) increasing the amount of time available for the completion of a task.

Extension Structure: As used in this disclosure, an extension structure is an inert physical structure that is used to extend or bridge the reach between any two objects.

Exterior: As used in this disclosure, the exterior is used as a relational term that implies that an object is not contained within the boundary of a structure or a space.

Fixed and Free End: As used in this disclosure, a fixed end refers to the congruent end of a first prism shaped structure that is associated with a first object that is secured to a second structure (such as an anchor point) of the first object. A free end refers to the congruent end of the first prism shaped structure of the first object that is not secured to the second structure of the first object. Examples of the prism shaped object include, but are not limited to. shafts, pipes, tubes, cords, webbings, and wires. The free end of the first prism shaped structure can be attached to a second object. For example, the free end of the arm (first prism shaped structure) of a u-shaped structure (the first object) can be used as a tenon that inserts into a mortise contained in a second object.

Footwear: As used in this disclosure, footwear refers to a protective structure that is worn on a foot. Footwear is commonly referred to as a shoe.

Force: As used in this disclosure, a force refers to a net (or unopposed) measurable interaction that changes the direction of motion of an object, the velocity of motion of an object, the momentum of an object, or the stress within an object. The term work refers to a measure of the amount of energy that is transferred through the application of a force over a distance. The term power refers to a measure of the amount of energy that is transferred over a period of time.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Framework: As used in this disclosure, a framework refers to the substructure of an object that forms the load path for the object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Impact: As used in this disclosure, an impact refers to an exchange of momentum between two objects over a duration. An impact often refers to a collision between two objects.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Lever: As used in this disclosure, a lever is a device that comprises a shaft that rotates around a fulcrum, axis of rotation, or pivot point. Levers are known for generating a mechanical advantage, known as leverage, when they are used to provide rotational force into a rotating mechanical system or device. A lever is an example of a simple machine.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Mechanical Advantage: As used in this disclosure, mechanical advantage is a measure of the ratio of the force generated by a mechanical device divided by force applied to the mechanical device. The leverage generated by a lever is an example of mechanical advantage. Typically, a mechanical advantage will amplify the force input into the mechanical device but does not impact the energy transfers through the mechanical device.

Momentum: As used in this disclosure, momentum is a measured quantity associated with the mass of a moving object. The momentum of the object equals the mass of the object multiplied by the velocity of the object. The exchange of momentum between two objects is a conserved quantity meaning that the sum of the momentums of the two objects before an exchange of momentum equals the sum of the momentums of the two objects after the exchange.

Mount: As used in this disclosure, a mount is a mechanical structure that attaches or incorporates an object into a load path.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Openwork: As used in this disclosure, the term openwork is used to describe a structure, often a surface, which is formed with one or more openings that allow for visibility and fluid flow through the structure. Wrought work and meshes are forms of openwork.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Pedestal: As used in this disclosure, a pedestal is an intermediary load bearing structure that forms a load path between a supporting surface and an object, structure, or load.

Perimeter: As used in this disclosure, a perimeter is one or more curved or straight lines that bounds an enclosed area on a plane or surface. The perimeter of a circle is commonly referred to as a circumference.

Pivot: As used in this disclosure, a pivot is a rod or shaft around which an object rotates or swings.

Platform: As used in this disclosure, a platform is a raised horizontal surface that forms a load path to support objects placed on the superior surface of the platform.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Reach: As used in this disclosure, reach refers to a span of distance between any two objects.

Rigid Structure: As used in this disclosure, a rigid structure is a solid structure formed from an inelastic material that resists changes in shape. A rigid structure will permanently deform as it fails under a force. See bimodal flexible structure.

Rotation: As used in this disclosure, rotation refers to the cyclic movement of an object around a fixed point or fixed axis. The verb of rotation is to rotate.

Striking Tool: As used in this disclosure, a striking tool is a tool that exchanges momentum in a controlled manner between two objects through an impact.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Telescopic: As used in this disclosure, telescopic is an adjective that describes a composite prism structure made of hollow prism-shaped sections that fit or slide into each other such that the center axis of the composite prism structure can be made longer or shorter by adjusting the relative positions of the hollow prism-shaped sections.

Tool: As used in this disclosure, a tool is a device, an apparatus, or an instrument that is used to carry out an activity, operation, or procedure. A tool generally comprises a working element and a handle.

U-Shaped Structure: As used in this disclosure, a U-shaped structure is a type of offset composite prism structure. The U-shaped structure is a three sided structure comprising a crossbeam, a first arm, and a second arm. In a U-shaped structure, the first arm and the second arm project away from the crossbeam: 1) in the same direction; 2) at a roughly perpendicular angle to the crossbeam, and, 3) the span of length of the first arm roughly equals the span of length of the second arm. An illiterate U-shaped structure refers to a U-shaped structure wherein the span of the length of the first arm differs from the span of the length of the second arm by more than 10 percent. A guided U-shaped structure refers to a U-shaped structure that has: a) the first arc formed by the interior cant formed between the first arm and the crossbeam is greater than or equal to 100 degrees; b) a second arc formed by the interior cant formed between the second arm and the crossbeam is greater than or equal to 100 degrees; and, c) the first arc and the second arc are roughly equal.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Working Element: As used in this disclosure, the working element of a tool is the physical element on the tool that performs the actual activity, operation, or procedure the tool is designed to perform. For example, the cutting edge of a blade is the working element of a knife.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A novelty device comprising a frame structure, a mechanical linkage, and a disciplinary tool;

wherein the frame structure includes a suspension platform with a plurality of telescoping legs to elevate the mechanical linkage and the disciplinary tool above a supporting surface;

wherein the novelty device is adapted to exchange momentum between an appropriate authority and a client;

wherein the mechanical linkage comprises a lever, a cam, a first pivot, a second pivot, a first connecting rod, and a second connecting rod;

wherein the lever, the cam, the first pivot, the second pivot, the first connecting rod, and the second connecting rod are mechanically interconnected;

wherein the lever mechanically attaches to the first pivot;

wherein the lever mechanically attaches to the first connecting rod;

wherein the lever rotates around the first pivot;

wherein the lever attaches to the first connecting rod such that the rotation of the lever moves the first connecting rod in a linear direction that is aligned with a center axis of the first connecting rod;

wherein the disciplinary tool comprises a handle and a working element;

wherein the handle is a rigid structure;

wherein the handle is a prism shaped structure;

wherein the second pivot attaches the handle to the suspension platform such that the handle rotates relative to the suspension platform;

wherein the second connecting rod attaches to a fixed end of the handle;

wherein the handle attaches to the second connecting rod such that a linear motion of the second connecting rod causes the handle to rotate around the second pivot;

wherein the working element is a mass that attaches to a free end of the handle;

wherein the working element forms the physical structure that impacts the client during an administration of disciplinary action;

wherein the rotation of the working element transfers momentum from the working element to the client.

2. The novelty device according to claim 1
wherein the novelty device is a disciplinary device;
wherein the novelty device is a striking tool;
wherein the momentum exchange is adapted to occur between the novelty device and the buttocks of the client;
wherein the mechanical linkage forms an energy transfer device that transfers the energy generated by the appropriate authority to the disciplinary tool.

3. The novelty device according to claim 2
wherein the plurality of telescopic legs transfers the load borne by the suspension platform to the supporting surface.

4. The novelty device according to claim 3
wherein the suspension platform is a rigid structure;
wherein the suspension platform is a u-shaped structure;
wherein the suspension platform attaches to the plurality of telescopic legs.

5. The novelty device according to claim 4
wherein each telescopic leg selected from the plurality of telescopic legs is a rigid structure;
wherein each selected telescopic leg is a composite prism structure;
wherein each selected telescopic leg is a load bearing structure;
wherein each selected telescopic leg transfers a portion of the load borne by the frame structure to the supporting surface;
wherein each selected telescopic leg is an adjustable structure;
wherein by adjustable is meant that the span of the length of the center axis of the composite prism structure of each telescopic leg selected from the plurality of telescopic legs can be changed;
wherein the suspension platform attaches to the plurality of telescopic legs such that the plurality of telescopic legs elevates the suspension platform above the supporting surface;
wherein the elevation of the suspension platform above the supporting surface adjusts by adjusting the span of the length of the center axis of each selected telescopic leg.

6. The novelty device according to claim 5
wherein the first connecting rod is a rigid structure;
wherein the first connecting rod is a prism shaped structure;
wherein the first connecting rod is a transfer structure;
wherein the first connecting rod transfers rotational energy received from the lever to the cam;
wherein the second connecting rod is a rigid structure;
wherein the second connecting rod is a prism shaped structure;
wherein the second connecting rod is a transfer structure;
wherein the second connecting rod transfers rotational energy received from the cam to the disciplinary tool.

7. The novelty device according to claim 6
wherein the lever is a rigid structure.

8. The novelty device according to claim 7
wherein the cam is a mechanical device;
wherein the cam attaches to the first connecting rod that is distal from the lever;
wherein the cam attaches to the second connecting rod;
wherein the cam attaches to the first connecting rod such that the linear motion of the first connecting rod causes the cam to rotate.

9. The novelty device according to claim 8 wherein the form factor of the working element resembles footwear.

* * * * *